United States Patent [19]

Bates

[11] Patent Number: 4,601,137

[45] Date of Patent: Jul. 22, 1986

[54] LOCKING MECHANISM FOR AN OFFICE PANEL SYSTEM

[75] Inventor: Norman H. Bates, Santa Ana, Calif.

[73] Assignee: The Tandem Group, Inc., Buena Park, Calif.

[21] Appl. No.: 518,692

[22] Filed: Jul. 29, 1983

[51] Int. Cl.[4] ..... E04B 2/76

[52] U.S. Cl. ..... 52/63; 52/221; 52/239; 52/242; 52/281; 52/586

[58] Field of Search ..... 52/36, 239, 242, 241, 52/243, 584, 127.9, 127.11, 127.12, 586, 582, 281, 63; 160/135

[56] References Cited

U.S. PATENT DOCUMENTS

| | | | |
|---|---|---|---|
| 3,049,197 | 8/1962 | Ludwig | 52/239 |
| 3,072,227 | 1/1963 | Baker | 52/241 |
| 3,327,440 | 6/1967 | Watkins | 52/239 |
| 3,425,171 | 2/1969 | Propst | 52/239 |
| 3,517,467 | 6/1970 | Propst | 52/36 |
| 3,766,696 | 10/1973 | Totoonchie | 52/241 |
| 3,797,184 | 3/1974 | Thompson | 52/239 |
| 3,807,112 | 4/1974 | Perina | 52/241 |
| 3,949,827 | 4/1976 | Witherspoon | 52/241 |
| 4,031,675 | 6/1977 | Roberts | 52/241 |
| 4,120,124 | 10/1978 | Temple | 52/36 |
| 4,158,936 | 6/1979 | Fulton | 52/242 |
| 4,434,900 | 3/1984 | Cook | 52/36 |

*Primary Examiner*—John E. Murtagh
*Attorney, Agent, or Firm*—Charles H. Schwartz; Ellsworth R. Roston

[57] ABSTRACT

A locking mechanism for joining first and second panels along facing sides, including a tubular member extending along the facing sides of the panels. A recess formed in each of the facing sides of the panels and with each recess of a depth to receive approximately half the width of the tubular member to have the tubular member substantially enclosed by the facing recesses. At least one locking member extending within each recess and with the locking members each having an enlarged head positioned within the recess. The tubular member including locking openings corresponding in number and position to the locking members and with the locking openings formed with an enlarged portion to receive the enlarged head of the locking member to have the enlarged head positioned within the interior of the tubular member. The locking openings formed with an elongated portion extending from the enlarged portion and with the width of the elongated portion smaller than the size of the enlarged head and with the tubular member moved axially to position the locking members within the elongated portions of the locking openings to have the enlarged heads captured within the tubular member to lock each of the panels to the tubular member.

26 Claims, 9 Drawing Figures

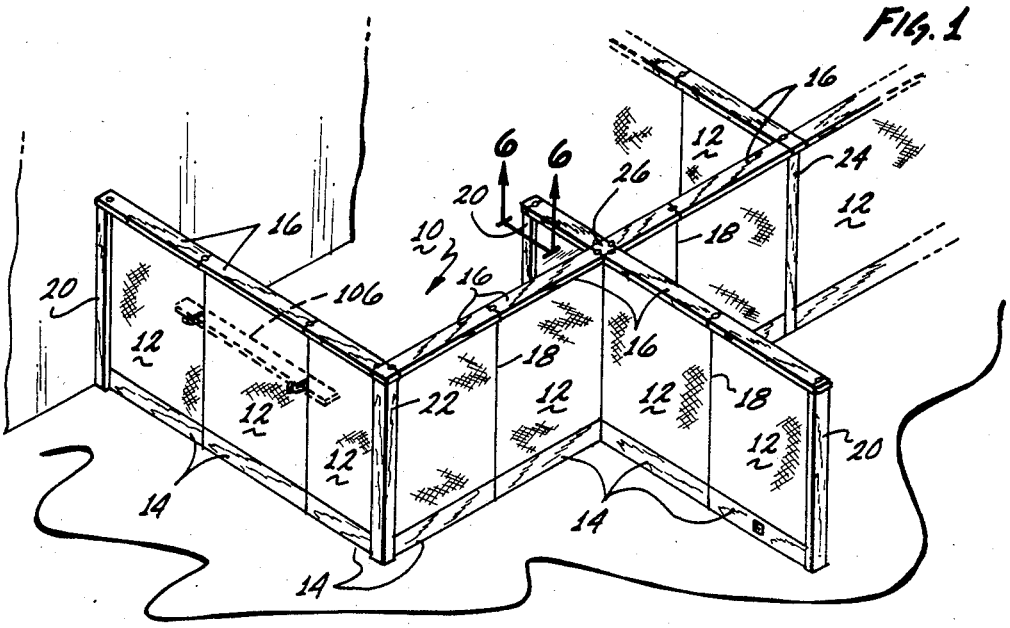
Fig. 1
6
6
20
10
16
26
12
24
18
106
22
14
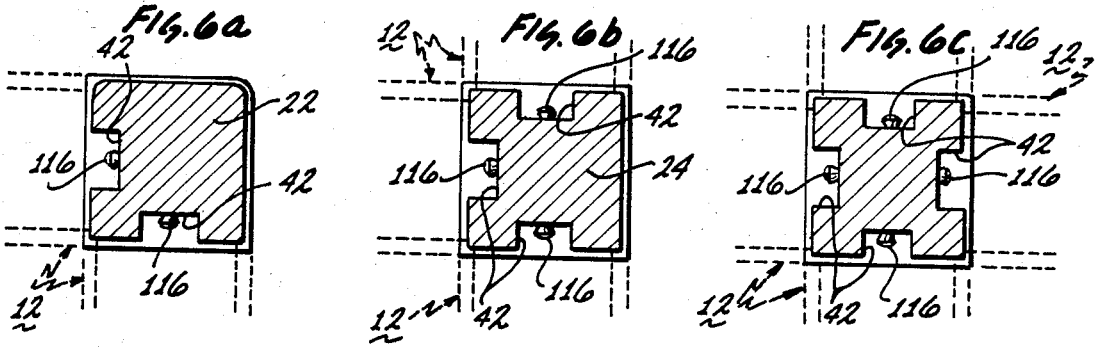
Fig. 6a
42
22
116
12
Fig. 6b
116
42
24
Fig. 6c
116
42
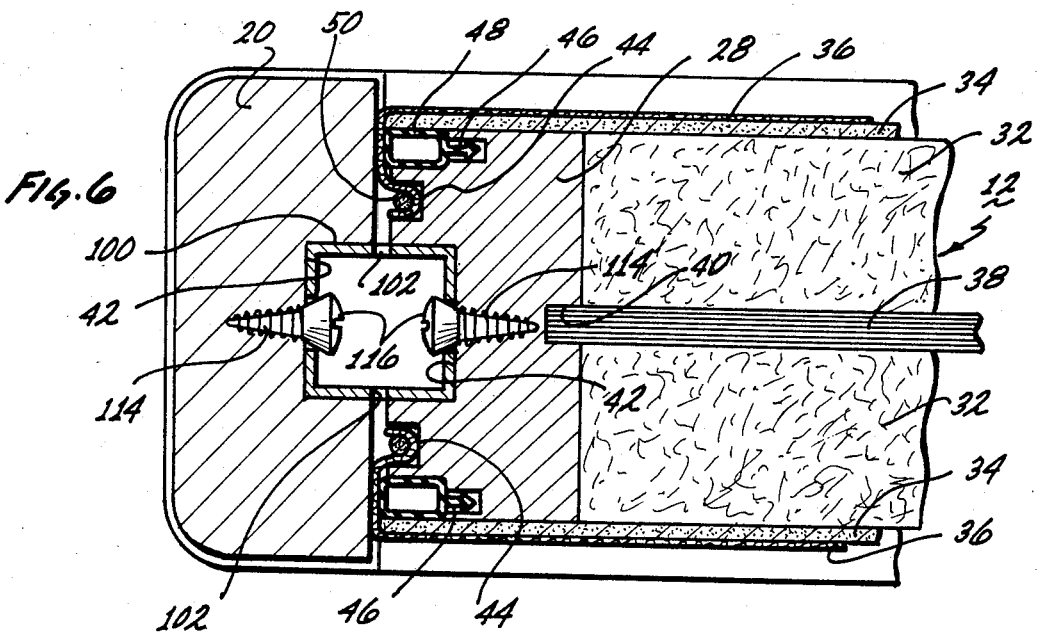
Fig. 6
20
50
48
46
44
28
36
34
32
12
100
102
42
114
40
38
116
102
46
44

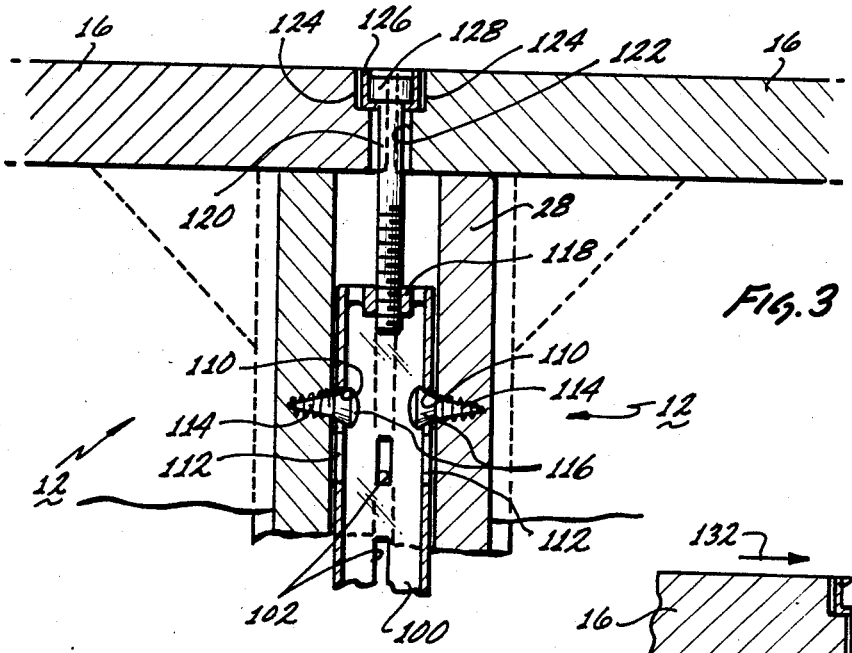
Fig. 3
Fig. 4
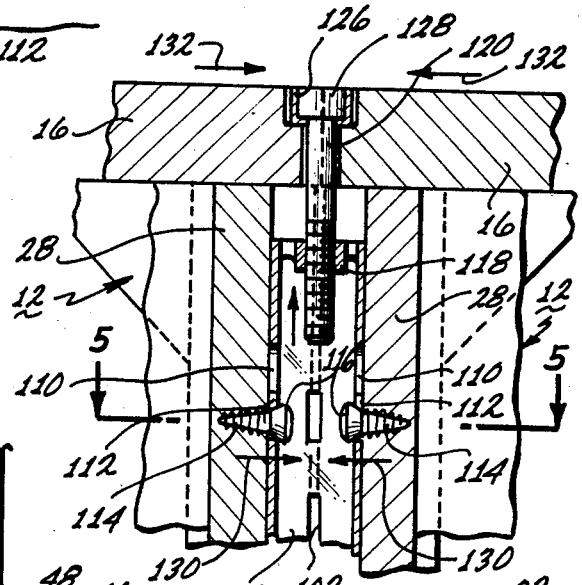
Fig. 5
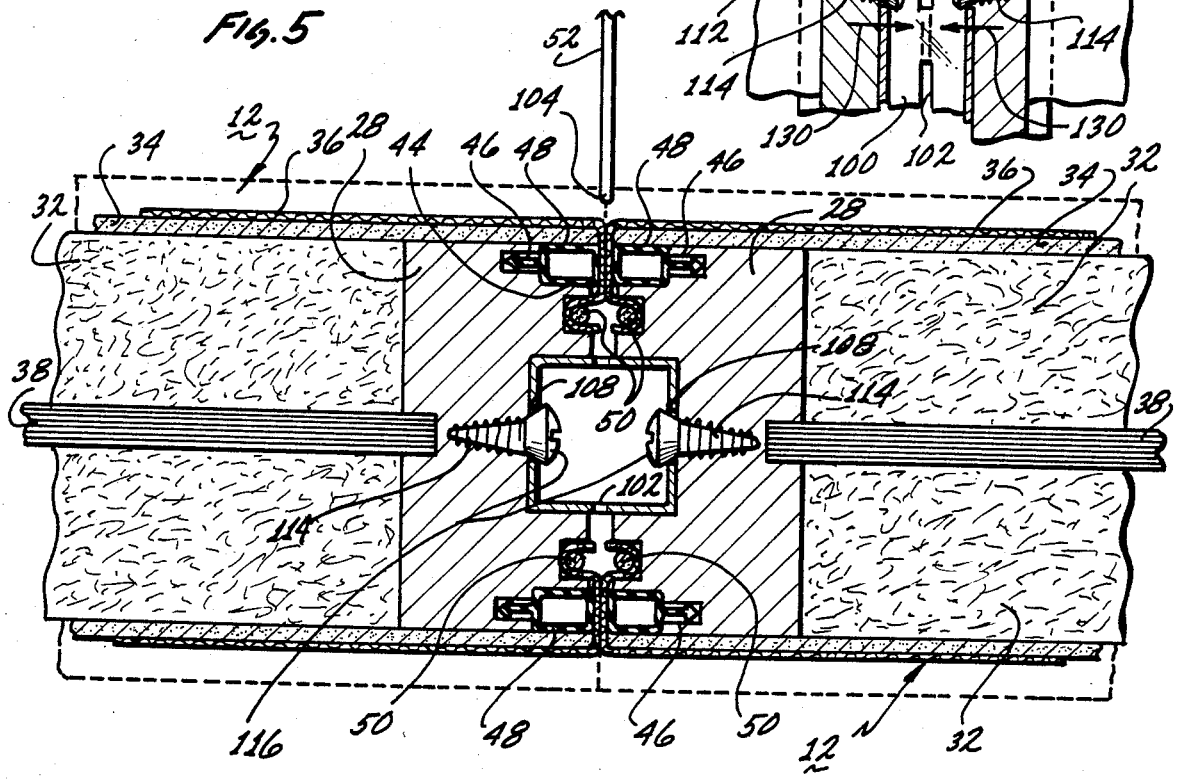

LOCKING MECHANISM FOR AN OFFICE PANEL SYSTEM

BACKGROUND OF THE INVENTION

1. Field of the Invention

The present invention relates to a locking mechanism for an office panel system and in particular is directed to a locking mechanism for joining together panels to form partitions which may define work areas and wherein such locking mechanism may receive and support mounting brackets which brackets can support shelves or other furniture structures.

2. Description of the Prior Art

Office panel systems have been designed so as to separate a large office space into a plurality of defined work areas. In addition, the panels themselves may be used to support shelves, desks, etc without the necessity of providing separate pieces of furnitures. These office panel systems are extremely versatile and allow for any given office space to be custom designed to meet the specific needs of a plurality of different workers, each with a defined work area.

In addition, the office panel systems are efficient in their use of space since each work area may encompass a desk or other working space, and with shelf space either above or below the working space or both and with the arrangement of each work area provided by joining the panels together in a desired spatial arrangement. The particular types of arrangements are only limited by the types of joints that are practical for joining the various panel members. These joints may provide for a series of panels arranged along a straight line and may also provide for right angle joints, T-joints and intersecting panels. In addition, angular relationships other than ninety degrees (90°) may be provided between the panels.

The panels serve as a wall or partition member to define the separate work areas and these panels may have various heights and widths dependent upon the particular use for the panels. The panels should be easily locked to each other so as to be able to quickly assemble the partitions and associated furniture to define the arrangement of the work areas. In addition, the panels should be easily unlocked from each other so that the arrangement may be changed or moved.

The prior art office panel systems have a number of difficulties and in particular are often difficult to both assemble and disassemble. Also with the prior art systems it is often difficult to align the panels precisely when assembled. In addition, the prior art devices often include the use of separate members which must be attached after the panels are assembled so as to hide the locking structure.

SUMMARY OF THE INVENTION

The present invention is directed to a novel locking mechanism for office panel systems for coupling together two (2) or more panels forming partitions so as to define work areas. Each panel includes a recess so as to receive a tubular member. Each panel also includes locking members extending within the recess and with the locking means having enlarged head portions. The tubular members includes complementary teardrop shaped openings so as to receive the enlarged head of the locking members. The upper end of the tubuler member includes a nut portion so as to receive a bolt and with the bolt passing through an opening at an upper end of the panel.

In operation, the tubular member is positioned within oppositely facing recesses in adjacent panels and with the enlarged head portions of the locking members passing through the enlarged portions of the teardrop shape openings in the tubular member. The bolt member is then passed through openings at the upper end of the panels to be received within the integral nut portion at the top of the tubular member. When the bolt member is tightened, the tubular member is drawn upward so that the enlarged heads of the locking members are moved within the elongated portions of the teardrop shape openings. The tubular member is then pulled tightly into and locked within the recesses in the panel members so as to firmly attach and align the panel members together. The attachment structure is hidden within the recesses and the only visible element would be the top of the bolt which may actually be received within recess portions of the panel members.

The invention also includes other structural advantages such as hinged bottom covers with unique fasteners so as to expose a bottom portion of the panel for various types of wiring. In addition, the adjacent edges of the panel may include resilient molding members so that the resilient molding members may be compressed to allow for shelf support members to be received and supported by the tubular members.

BRIEF DESCRIPTION OF THE DRAWINGS

A clearer understanding of the invention will be had with reference to the following descriptions and drawings wherein:

FIG. 1 illustrates a perspective view of an office panel system of the present invention arranged to provide a plurality of work areas;

FIG. 3 is a detailed cross-sectional view illustrating the locking mechanism when initially engaging the panel members;

FIG. 4 is a detailed cross-sectional view illustrating the locking mechanism engaged to join together the panel members;

FIG. 5 is a top cross-sectional view taken along lines 5—5 of FIG. 4 illustrating the locking member joining panel members;

FIG. 6 is a top cross-sectional view taken along lines 6—6 of FIG. 1 illustrating an end joint member locked to a panel member with the locking mechanism;

FIG. 6*a* is a top cross-sectional view of a right angle joint member for the office panel system.

FIG. 6*b* is a top cross-sectional view of a T-joint member for the office panel system; and FIG. 6*c* is a top cross-sectional view of a cross joint member for joining intersecting panels.

As shown in FIG. 1 an office panel system 10 is composed of a plurality of separate panel members 12. The panel members may have various widths but in general, for each particular office system, the panel members would be of the same height. However, if desired, panel members of different heights may be used.

Figure 2:
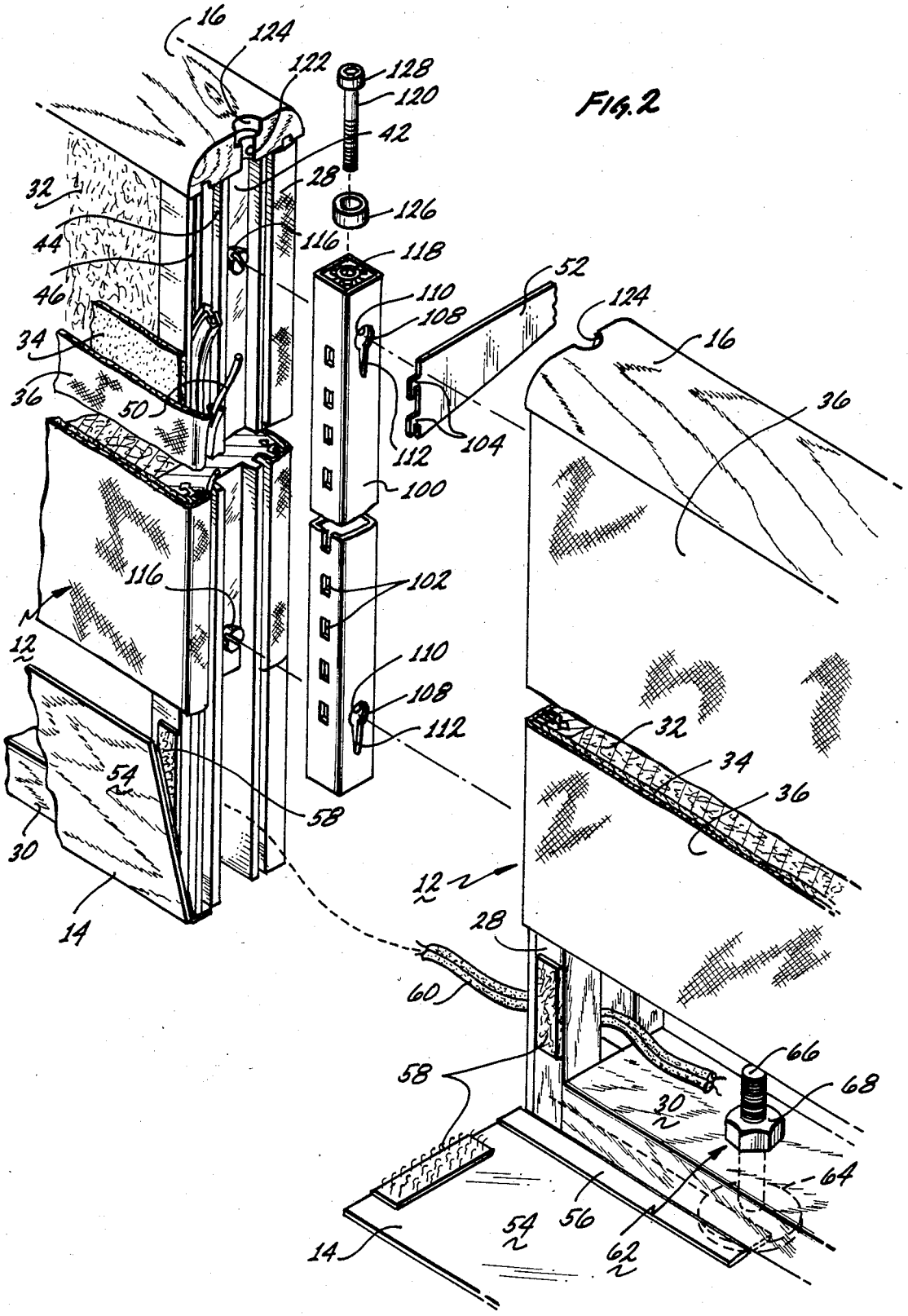
FIG. 2 is an exploded perspective detailed view of the locking mechanism of the present invention used to join adjacent panels.

Each panel member 12 in general includes a bottom portion 14, which bottom portion 14 may be used to house various wiring to provide for electrical outlets, telephone outlets etc. In addition, each panel member 12 includes a top cover portion 16. In the particular embodiment shown, the cover portions 16 are shown to be separate attached elements but the cover portions may be formed integrally with the panels 12. With the present invention, the cover portions 16 may be permanently attached or integrally formed since it is not necessary to remove the cover members to expose a locking structure.

As shown in FIG. 1 the office panel system 10 of the present invention may have the panels joined directly together, as shown at positions 18, or may have the panels joined together or have the ends finished off by the use of joint members. In particular, joint member 20 is used to finish off the end of a panel member; joint member 22 provides for joining together panels members forming a right angle; joint member 24 provides for joining together panel members forming a T; and joint member 26 provides for forming together intersecting panel members forming a cross. FIGS. 6, 6*a*, 6*b* and 6*c* illustrate top cross-sectional views of the end joint member 20, right angle joint member 22, T-joint member 24 and intersecting joint member 26.

FIG. 2 illustrates in an exploded cross-sectional view, two (2) panel members 12 to be joined together. As shown in FIG. 2, each panel member 12 is formed by a frame including side rails 28, a bottom rail 30 and the top cover member 16 which also serves as a top rail. The interior of the panels 12 may be filled with a foam material 32 and with a resilient sheet 34 overlaying the foam material 32 and the side rails 28 to provide for a smooth surface. The outside of the panel 12 is covered with an outer covering 36, which may be preferably a decorative outer fabric. As shown in FIG. 6, the layers of material 32, 34 and 36 are positioned on either side of a center board 38 and with similar layers 32, 34 and 36 located on both sides of the center board 38. The center board 38 fits within a groove 40 in the side rails 28 so that each panel structure forms a rigid partition to serve as a wall. The various layers of material also provide for high levels of sound attenuation to isolate the work areas from each other.

Each side rail 28 includes a number of outer recesses. In particular, a large rectangular central recess 42 is used to receive the locking mechanism of the present invention. To either side of the large recess 42 are located smaller recesses 44 and 46. Disposed within the recesses 46 are resilient rubber-like molding members 48. The molding members 48 project a short distance from the face of the end rail 28 and allow for the outside covering 36 to be folded around the end of the layer of resilient material 34 and the molding 48 to be received within the recess 44. The layer of material 36 may then be locked in position within the recess 34 through the use of a bead 50. As an alternative to the use of the recess 44 and the bead 50, the material 36 may be stapled to the front face of the side rail 28.

As shown in FIG. 5, the use of the molding 48 projecting from the face of the side rail 28 insures that when the panels 12 are locked together the edges mate. In addition, because the molding 48 and the layer of material 34 are resilient, this allows for a shelf support 52 to be inserted between the adjacent panels 12 to be received within the interior for supporting the shelf support at an interior position.

As can be seen in FIG. 2, the bottom portion 14 of the panels 12 include a hinged cover 54 hinged along the bottom by hinge member 56 and with the cover held in a closed position through the use of a fastener such as a velcro fastener 58. When the hinge panel is pulled downward, as shown in FIG. 2, this exposes a bottom interior channel to allow for the passage of wiring such as wiring 60 and also to give access to levelers 62. The levelers 62 include a leveler pad 64 which is located at the end of a bolt 66 and with a nut member 68 allowing for the adjustment of the leveler pad 64 upward and downward so as to provide for adjustment of the panels 12 relative to any irregularities in the flooring.

The panels 12 and other joining members are interlocked through the use of a locking mechanism, including a square tubular member 100, which tubular member 100 is designed to fit within the recesses 42 in adjacent panels or in joining members. The tubular member 100 includes a plurality of spaced retangular openings 102 located on opposite sides of the tubular member 100 and positioned to face outwardly to receive any support members such as the shelf support 52 shown in FIG. 2. As shown in FIG. 2, the shelf support includes a pair of hook flanges 104 which are spaced apart the same distance as the spacing between adjacent openings 102. The shelf member may therefore be pushed between adjacent panel members 12 to have the hook flanges 104 engage the openings 102. When the shelf support is then pushed downward the shelf support is locked in position. The shelf support may now receive and support a shelf member such as a shelf member 106 shown in dotted line in FIG. 1. It is to be appreciated however, that other members may be supported from the panel members 12 such as larger work areas, bookcases, credenzas, etc.

The tubular member 100 also includes teardrop shaped openings 108 located generally at top and bottom positions and on opposite sides of the tubular member. The teardrop shape openings 108 include, in general, an enlarged opening 110 which may, for example, be formed as a circular opening and extending from the enlarged opening 110, a tapered elongated opening 112 having a width less than the diameter of the enlarged opening 110.

The recesses 42 in the side rails 28 include locking screw members 114 which extend outwardly within the recesses 42. As shown in FIG. 2, the locking screws 114 are spaced along the recesses 42 the same distance as the spacing between the openings 108 along the tubular member 100. The locking screw members 114 have an enlarged head portion 116 and preferably the enlarged head 116 is chamferred or tapered backward from the enlarged head to the body of the screw member 114. The largest diameter for the enlarged head 116 is smaller in size than the diameter of the enlarged portion 110 of the teardrop shape opening 108. However, the largest dimension for the enlarged head 116 is greater than the width across the elongated portion 112 of the opening 108. Also, the smallest width of the elongated portion 112 is smaller than the diameter of the chamferred portion of the elongated head 116.

This above arrangement allows for the enlarged head 116 of the locking screw to be received within the interior of the tubular member 100 through the enlarged portion 110 of the openings 108. However, if the tubular member is then drawn upward the chamferred portion of the enlarged head 116 will now enter and be ultimately wedged within the elongated portion 112 of the openings 116.

In order to provide for the tubular member 100 being drawn upward, the upper end of the tubular member 100 includes an integral nut member 118 as shown in FIGS. 2, 3 and 4. The integral nut member 118 is designed to receive a bolt 120 and with the bolt 120 passing through an opening 122 formed between adjacent top rail members 16. The opening 122 includes an enlarged portion 124 to receive first a washer 126 and then a head portion 128 of the bolt member 120. This can be seen in more detail in FIGS. 3 and 4.

FIG. 3 illustrates the tubular member positioned between the panel members 12 within the recesses 42 and with the enlarged head 116 of the locking screw 114 passing within the tubular member 100 through the enlarged openings 110. The bolt 120 is positioned within the integral nut portion 118 but has not been tightened to draw the tubular member 100 upward.

As shown in FIG. 4, the bolt member 120 has now been tightened to draw the tubular member 100 upward and with the enlarged head now being forced into the elongated portion 112 so that the panel members 12 are locked together. Because the enlarged head 116 has a chamferred surface, the chamfer acts in combination with the tapering of the elongated portion 112 to draw the panel members 12 together as shown by the opposing arrows 130 and 132. The panels are now tightly locked together and aligned and with this locking occurring without any further assembly of the panel members.

In order to disassemble the panels, the bolt 120 is loosened to have the bolt extend past the top surface of the top rails 16. The bolt 120 may now be pushed or hammered down to drive the tubular member 100 downward to disengage the enlarged head 116 from the elongated portion 112 and position the enlarged head within the enlarged portion 110 of the opening 108. The panels 12 may now be pulled apart.

In order to accomodate various panel arrangements, different types of joint members may also be used as shown in FIGS. 6, 6*a*, 6*b* and 6*c*. In FIG. 6, an end joint member 20 is shown which end joint member also includes a recess 42 with screw members 114 having enlarged heads 116. The tubular member 100 may then interlock the joint member 20 at the end of a panel 12 to finish off the end as shown in FIG. 1.

FIG. 6*a* illustrates a right angle joint member 22 having recesses 42 located at right angles and with the recesses including screw members 114 with enlarged heads 116. The joint member 22 is used to join together panel members 12 at right angles to each other as shown in FIG. 1. FIG. 6*b* illustrates joint members 24 having recesses 42 located on three sides and also with the recesses including screw members 114 with enlarged heads 116. The joint member 24 is used to join panel members in a T-arrangement, again as shown in FIG. 1. Finally, FIG. 6*c* illustrates the joint member 26 having recesses 42 located on all four sides and with the recesses including screw members 114 with enlarged heads 116. The joint member 26 is used to join together intersecting panel members to form a cross arrangement. It will be appreciated that the various joining members 22, 24 and 26 may have faces located at angles other than ninety degrees (90°) so as to join together panel members in angular arrangements other than ninety degrees (90°).

The present invention therefore is directed to a locking mechanism for an office panel system wherein the panel members are completely constructed prior to assembly and with no need to affix separate cover portions after assembly so as to hide locking structures. The locking mechanism of the present invention includes a tubular member positioned within recesses in adjoining panels or joint members and with the panels or joint members including screws having enlarged heads for reception within complementary openings within the tubular member. The tubular member may then be moved axially so as to lock the enlarged heads within the tubular member and thereby join the panels or joint members together. The movement of the tubular member may be accomplished by a bolt threaded within an integral nut portion in the tubular member. In a preferred embodiment, the bolt is positioned at the top of the panel structure but is to be appreciated that the bolt may be located at a bottom position. The invention also includes improved structure for an office panel system such as a hinged lower panel for gaining access to wiring and to other structures for providing for easy fabrication of the office panel system.

Although the invention has been described with reference to a particular embodiment, it is to be appreciated that various adaptations and modifications may be made and the invention is only to be limited by the appended claims.

I claim:

1. A locking mechanism for joining first and second panels along facing sides and with the facing sides formed by side rails integral to the panels and with each panel including a top rail member extending along the full length of the panel and adjacent a top rail of an adjacent panel and with the edges of adjacent top rails including complementary facing recesses together forming an opening passing through the adjacent top rails, including a tubular member extending along the side rails forming the facing sides of the panels, a recess integrally formed in each of the side rails forming the facing sides of the panels and with each recess of a depth to receive approximately half the width of the tubular member and with each recess of a width substantially the same as the depth of the tubular member to have the tubular member substantially enclosed by the facing recesses, at least one locking member extending within each recess and with the locking members each having an enlarged head with a chamferred surface positioned within the recess, the tubular member including locking openings corresponding in number and position to the locking members and with the locking openings formed with an enlarged portion to receive the enlarged head of the locking member to have the enlarged head with the chamferred surface positioned within the interior of the tubular member and with the locking openings formed with a tapered elongaged portion extending from the enlarged portion and with the width of the tapered elongaged portion smaller than the size of the enlarged head with the chamferred surface, and means positioned within and passing through the opening formed in the adjacent top rails for moving the tubular member axially to position the locking members within the elongated portions of the locking openings to have the chamferred surface of the enlarged heads captured against the tapered elongated portions of the locking openings of the tubular member to lock each of the panels to the tubular member and draw each of the facing sides of the panels against each other to firmly attach and align the panels to each other.

2. The locking mechanism of claim 1 wherein the tubular member is substantially rectangular and the recesses are also substantially retangular.

3. The locking mechanism of claim 2 wherein the tubular member is square.

4. The locking mechanism of claim 1 wherein the locking members are formed at screws and with the panels formed with side rails and with the screws screwed into the side rails within the recesses formed in the side rails.

5. The locking mechanism of claim 1 including two locking members located at top and bottom positions and with complementary locking openings at top and bottom positions of the tubular member.

6. The locking mechanism of claim 1 wherein the enlarged heads of the locking members are formed as chamferred heads tapering back toward the recess from the largest dimension for the enlarged head.

7. The locking mechanism of claim 6 wherein the elongated portions of the locking openings are tapered to have the chamferred heads wedged into the elongated portions to pull the panels together.

8. The locking mechanism of claim 1 wherein the elongated portions of the locking openings are tapered to have the enlarged heads wedged into the elongated portions.

9. The locking mechanism of claim 1 wherein the means for moving includes a integral nut positioned at one end of the tubular member and a bolt extending through the panels to engage the nut and provide axial movement of the tubular member as the bolt is threaded into the nut.

10. The locking mechanism of claim 9 wherein the nut is located at the top of the tubular member and the bolt extends through and is retained by a recess formed in each pair of abutting top rails at the top of the panels.

11. The locking mechanism of claim 1 additionally including a end joint member including substantially the same recess and locking member as the panel members for locking to and finishing off an end of a panel.

12. The locking mechanism of claim 1 additionally including an angle joint member including substantially the same recess and locking member as the panel members on at least two sides at an angle to each other and with the angle joint located intermediate the panels to lock the panels to the angle joint member and thereby position the panels at an angle to each other.

13. The locking mechanism of claim 1 additionally including a T-joint member including substantially the same recess and locking member as the panel members on three sides each at right angles to the adjacent side and with the T-joint located intermediate three panels to lock the panels to the T-joint member and thereby position the panels to form a T-arrangement.

14. The locking mechanism of claim 1 additionally including an intersecting joint member including substantially the same recess and locking member as the panel members on four sides each at right angles to the adjacent side and with the intersecting joint member located intermediate four panels to lock the panels to the intersecting joint member and thereby position the panels to form an intersecting cross.

15. The locking mechanism of claim 1 wherein the panels additonally include a hinged bottom cover extending along the bottom edge of the panels to provide access to a bottom cavity extending along the panels.

16. The locking mechanism of claim 15 wherein the hinged cover to closed with a multiple hook and loop type fastener.

17. The locking mechanism of claim 1 wherein the panels are covered with an outer fabric and with the facing sides of the panels additionally including flexible molding located at outer edge portions of the facing sides and with the outer fabric folded around the outer edge portions to cover the molding and with the outer fabric and molding lightly compressed when the panels are locked together by the locking mechanism.

18. The locking mechanism of claim 17 wherein the molding is located in additional recesses in the facing sides and with the molding extending past the recesses.

19. The locking mechanism of claim 17 wherein the outer fabric is locked in position by bead members which lock the fabric within additional recesses in the facing sides.

20. A locking mechanism for joining, at least first and second members along facing sides and with the facing sides formed by side rails integral to the first and second members and with each member including a top rail extending along the full length of the member and adjacent a top rail of an adjacent member and with the edges of adjacent top rails including complementary recesses together forming an opening passing through the adjacent top rails, including a tubular member extending along the side rails forming the facing sides of the members, a recess integrally formed in each of the side rails forming the facing sides of the members and with each recess of a depth to receive approximately half the width of the tubular member and with each recess of a width substantially the same as the depth of the tubular member to have the tubular member substantially enclosed by the facing recesses, at least one locking member extending within each recess and with the locking members each having an enlarged head with a chamferred surface tapering back and positioned within the recess, the tubular member including locking openings corresponding in number and position to the locking members and with the locking openings formed with an enlarged portion to receive the enlarged head with the chamferred surface positioned within the interior of the tubular member and with the tapered elongated portion and with the width of the tapered elongated portion smaller than the size of the enlarged head with the chamferred surface, and means positioned within and passing through the opening formed in the adjacent top rails for moving the tubular member axially to position the locking members within the tapered elongated protions of the locking openings to have the chamferred surface of the enlarged heads wedged within the tapered elongated portion to pull together and lock each of the members to the tubular member and to draw each of the facing sides of the members against each other to firmly attach and align the members to each other.

21. The locking mechanism of claim 20 wherein the tubular member is substantially square and the recesses are substantially retangular.

22. The locking mechanism of claim 20 wherein the means for moving includes a integral nut positioned at the top end of the tubular member and a bolt extending through and retained by a recess formed in each pair of abutting top rails at the top of the members to engage the nut and provide axial movement of the tubular member as the bolt is threaded into the nut.

23. The locking mechanism of claim 20 wherein one of the members is an end joint member and the other is panel to have the end joint finish off an end of the panel.

24. The locking mechanism of claim 20 wherein one of the members is an angle joint member and including two other panel members located on at least two sides of the angle joint member and with the angle joint number located intermediate the two panels to lock the panels to the angle joint member and thereby position the panels at an angle to each other.

25. The locking mechanism of claim 20 wherein one of the members is a T-joint member and including three other panel members located on three sides of the T-joint member and with the T-joint member located intermediate the three panels to lock the panels to the T-joint member and thereby position the panels to form a T-arrangement.

26. The locking mechanism of claim 20 wherein one of the members is an intersecting joint member and including four other panel members located on four sides of the intersecting joint member and with the intersecting joint member located intermediate the four panels to lock the panels to the intersecting joint member and thereby position the panels to form an intersecting cross.

* * * * *